United States Patent [19]

Akhundov et al.

[11] 3,940,687

[45] Feb. 24, 1976

[54] METHOD FOR CONTROLLING ACTIVE POWER DISTRIBUTION IN POWER TRANSMISSION LINES AND A CONTROLLER FOR EFFECTING SAME

[76] Inventors: Enver Bejukovich Akhundov, ulitsa Volgogradskaya, 21b, kv. 6; Vadim Andreevich Anischenko, ulitsa Gorkogo, 23, kv. 17; Vladimir Vasilievich Petrov, ulitsa Matusevicha, 6, kv. 45; Petr Stepanovich Semashko, ulitsa Tipografskaya, 3, kv. 65, all of Minsk, U.S.S.R.

[22] Filed: May 2, 1974

[21] Appl. No.: 466,186

[52] U.S. Cl. ..... 323/101; 323/108

[51] Int. Cl.[2] ..... G05F 1/66

[58] Field of Search..... 321/5, 8 R, 27 R; 323/101, 323/102, 106, 108, 109, 110, 119

[56] References Cited

UNITED STATES PATENTS 3,683,262 8/1972 Neuffer et al..... 321/5

*Primary Examiner*—A. D. Pellinen

*Attorney, Agent, or Firm*—Lilling & Siegel

[57] ABSTRACT

Automatic control apparatus and a method for controlling the active power flow distribution in power transmission lines and a controller for effecting same. The control of active power flow in a power transmission line is effected by the selection of either a proportional-plus-integral or integral control is carried out by comparing the sum of the nearest maximum extrapolated difference between the preset and actual values of active power flow and its preset value with the permissible value of active power flow. If the sum is greater than the permissible value of active power flow, a proportional-plus-integral control is effected, whereas an integral control is carried out if the sum is smaller than the permissible value.

The controller effecting the above method is provided with a logical unit to ensure the selection of either proportional-plus-integral or integral mode of control, a transducer for active power flow, a setter for the preset power flow, a setter for the permissible value of active power flow, which means shape the input signals of said logical unit. The output signal of the logical unit ensures the connection of an amplifier for effecting the control in the proportional-plus-integral mode.

6 Claims, 4 Drawing Figures

METHOD FOR CONTROLLING ACTIVE POWER DISTRIBUTION IN POWER TRANSMISSION LINES AND A CONTROLLER FOR EFFECTING SAME

BACKGROUND OF THE INVENTION

The method according to the present invention relates to the art of automatic control in power engineering and more particularly to automatic control of active power distribution in power transmission lines.

Several principles of effecting automatic control of power distribution in power transmission lines are known in the art, such as, for example, a control system implemented in the network coupling the Krasnoyarsk system to the joint power system of Western Siberia. A characteristic feature of this and other similar systems resides in the fact that 1) in case the deviation of the controlled power flow from the mean value is comparatively small, the power flow being distributed not exceeding the set value of the limiter, the power flow is integrally controlled at a rather low rate, whereas 2) if the deviation of the controlled power flow from the mean value is so great that the distributed power flow exceeds the set value of the limiter, a high-speed proportional-plus-integral control is effected at a very high rate.

A disadvantage of the above principle of control is that a fast (proportional-plus-integral) control is carried out all the time the distributed power flow exceeds the value of the limiter setting, without taking into consideration the fact that almost any deviation of the distributed power flow which reaches the value of the limiter setting is likely to exceed, during the ensuing period of time, the limit of power that is being distributed along a given transmission line, which limit is selected with the aim of ensuring a stable parallel operation of the power system or preventing thermal overload of the line. In the case under consideration, the control system is bound to run idle most of the time, inasmuch as there frequently occur such power flow deviations that, while exceeding the value of limiter setting, do not cause any line overload. The result is that the overall capacity of the power transmission line is not used to the full extent when it is required to transmit a heavy power flow. Moreover, it tends to increase the costs and impair the reliability of operation of the power stations engaged in distributing the flows of power, said power stations being forced to operate overtime under the undesirable conditions of rapidly varying loads.

SUMMARY OF THE INVENTION

It is an object of the present invention to provide a method for controlling active power flow distribution and a device for effecting same, which will permit increasing the overall capacity of the power transmission line and promote effectiveness and reliability of controlling power stations.

The invention is based on the implementation of a principle whereby an integral or proportional control of power flow in a power transmission line is selected on the strength of the data obtained from evaluation of probable values of active power flows over certain time intervals counted from the moment an actual active power flowing in a given transmission line has been measured.

The object of the invention is achieved by a method for controlling active power flow distribution in a power transmission line of a power system wherein the value of active power flow in a power transmission line intended to be maintained during the process of controlling same is preset, the actual value of active power flow in said power transmission line is measured, said actual and preset values of active power flow are compared and in accordance with the difference between these values of active power flow an integral control is carried out for the case when the power flow does not exceed the preset limiting value, or, in case the power flow exceeds the preset limiting value a proportional-plus-integral control is carried out respectively, wherein, according to the invention, the permissible value of power for a given power transmission line selected to ensure stable operation of the power system is adopted as the preset limiting value of the active power flow, the difference between said actual and preset values of active power flow carried by said power transmission line is converted into the nearest maximum extrapolated difference between the actual and preset values of active power flow, the nearest maximum extrapolated difference between the actual and preset values of active power flow is added to the preset value of active power flow, and said sum obtained by adding the nearest maximum extrapolated difference between the actual and preset values of active power flow and the preset value of active power flow is compared with the permissible value of active power flow in the power transmission line, thereupon a proportional-plus-integral control of active power flow is carried out of said sum of the nearest maximum extrapolated difference between the actual and preset active power flows and the preset value of active power flow is greater than the permissible value of active power flow in said power transmission line, or integral control of active power flow, if said sum of the nearest maximum extrapolated difference between the actual and preset values of active power flow and the preset value of active power flow is smaller than the permissible value for the active power flow in the given power transmission line.

In the method for controlling active power flow distribution in a power transmission line of the present invention the nearest maximum extrapolated difference between the actual and preset values of active power flow is preferably selected from a series of extrapolated differences between the actual and preset values of active power flows determined respectively for different time intervals, relative to the moment of measuring the actual value of active power flow using the following formula:

$$\Delta P_1(\Delta t) = \frac{\alpha e^{-\quad \beta\Delta t} - \beta e^{-\quad \alpha\Delta t}}{\alpha - \beta}\,\Delta P_1 + \frac{e^{-\quad \beta\Delta t} - e^{-\quad \alpha\Delta t}}{\alpha - \beta}\cdot\frac{d\Delta P_1}{dt} \quad (I)$$

wherein $\Delta P_1$ is the difference between the actual and preset values of active power flows in a power transmission line at the moment of time the actual value is measured and relative to which the time intervals $\Delta t$ are read off; $\Delta P_1$ ($\Delta t$) is the difference between the actual and preset values of active power flow $\Delta P_1$ in the time interval $\Delta t$; $\alpha$ and $\beta$ are coefficients characterizing the probability of active power flow fluctuations in the power transmission line.

It is also expedient to provide a controller for the active power flow distribution in the power transmission line for putting the method of the present invention into practice, comprising a transducer of active power flow, a setter of active power flow, an adder having two inputs, whose one input is connected to the output of the active power flow transducer and the other input is connected to the output of the active power flow setter, an integrator whose input is connected to the output of said adder, an amplifier whose input is connected to the output of said adder, a controlled gate whose input is connected to the output of said amplifier, an output adder having two inputs, one input thereof being connected to the output of said integrator and the other input thereof being coupled to the output of said amplifier via said controlled gate, a control signal for controlling the active power flow in said power transmission line being shaped at the output of said output adder, the controller, according to the invention, containing a permissible active power flow setter and a logical unit which effects the selection of a proportional-plus-integral or integral control of the active power flow to be distributed, having three inputs and an output, the first input thereof being connected to the output of said adder, the second input being connected to the output of said active power flow setter, the third input being connected to the output of said active power flow setter, while the output thereof is connected to the control input of said controlled gate.

The logical unit in the active power flow controller for distributing active power flow in power transmission lines of the present invention preferably comprises a sawtooth voltage generator, a control gate whose input is the first input of the logical unit and whose control input is connected to the output of the sawtooth voltage generator, an extrapolation unit for extrapolating the maximum difference between the actual and preset values of active power flows, having two inputs, one input thereof being connected to the output of the control gate, which gate is an element of the logical unit, while the other input thereof is connected to the output of said sawtooth voltage generator, an adder having two inputs, one input thereof being connected to the output of the extrapolation unit for extrapolating the maximum difference between the actual and preset values of the active power flows, while the other input thereof is the second input of the logical unit, a comparator having two inputs and an output, one input thereof being connected to the output of the adder that is an element of the logical unit, the other input thereof being the third input of said logical unit and whose output is the output of the logical unit.

The present invention for controlling the active power flow distribution in power transmission lines, when realized, will increase the overall capacity of the power transmission lines, improve the reliability of operation of control power stations and enhance stable operation of the relevant power distribution system comprised of said power transmission lines and control power stations.

BRIEF DESCRIPTION OF THE DRAWINGS

Given below is a detailed description of the method according to the present invention and an embodiment of the controller for controlling the active power flow distribution realizing said method, presented in conjunction with accompanying drawings wherein.

DESCRIPTION OF THE PREFERRED EMBODIMENT

The method consists in that a change-over from the slow integral to fast proportional-plus-integral control is carried out only when the next in time maximum value of active power flow to be distributed exceeds the permissible value.

Figure 1:
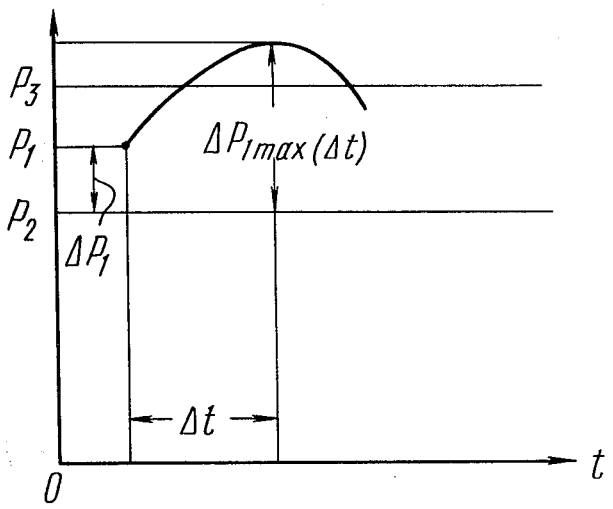
FIG. 1 illustrates a diagram of active power flow distribution in a power transmission line for effecting proportional-plus-integral control.
Figure 2:
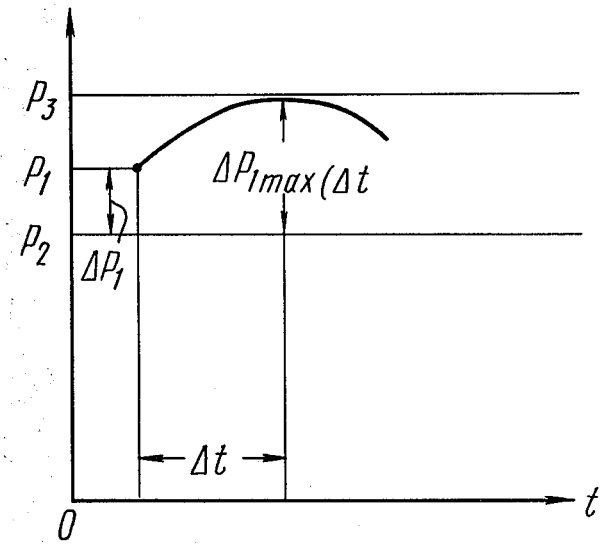
FIG. 2 shows a similar diagram involving the carrying out of integral control.

The object is achieved by presetting a desired value of active power flow $P_1$ (FIGS. 1 and 2) in the power transmission line under consideration, which value is to be maintained in the control process. Then the actual value of active power flow $P_1$ in said power transmission line is measured to obtain the difference $\Delta P_1$ between the actual and preset values of active power flow.

Further, the nearest maximum extrapolated difference $\Delta P_1$ max ($\Delta t$) of the actual and preset values of active power flow is selected from a series of extrapolated differences $\Delta P_1$ ($\Delta t$) of actual and preset values of active power flows, determined respectively for different time intervals relative to the moment the actual active power flow is measured by the formula:

$$\Delta P_1(\Delta t) = \frac{\alpha e^{-\beta\Delta t} - \beta e^{-\alpha\Delta t}}{\alpha - \beta}\Delta P_1 + \frac{e^{-\beta\Delta t} - e^{-\alpha\Delta t}}{\alpha - \beta} \cdot \frac{d\Delta P_1}{dt} \quad (I),$$

wherein $\Delta P_1$ is the difference between the actual and preset values of active power flows at the moment the actual values are measured, relative to which the time intervals are read off;

$\Delta P_1(\Delta t)$ is the difference between the actual and preset values of active power flow extrapolated to the time interval $\Delta t$; $\alpha$ and $\beta$ are coefficients characterizing the probable character of active power flow fluctuations in the power transmission line.

The coefficients $\alpha$ and $\beta$ essentially define the autocorrelation function of stochastic fluctuations of active power flows and can be predetermined by steric treatment, using known algorithms, of actual fluctuations of active power flow in the power transmission line under consideration.

Thereafter the nearest maximum extrapolated difference obtained $\Delta P_1$ max ($\Delta t$) is added to the preset value of active power flow $P_2$ and the sum total $\Delta P_1$ max ($\Delta t$) + $P_2$ is compared with the preset permissible value for the active power flow $P_3$ in the power transmission line under consideration.

A proportional-plus-integral control will be carried out, provided the sum total $\Delta P_1$ max $(\Delta t) + P_2$ exceeds the permissible value for $P_3$ (FIG. 1) using the formula:

$$\Delta P_4 = k_1 \int \Delta P_1 dt + k_2 \Delta P_1 \quad \text{(II)}$$

wherein $\Delta P_4$ is the control signal, $k_1$ and $k_2$ are constant factors determining the adjustment of the controllers.

An integral control will be carried out if the sum total of $\Delta P_1$ max $(\Delta t) + P_2$ is smaller than the permissible value of $P_3$ (FIG. 2) using the following formula:

$$\Delta P_4 = k_1 \int \Delta P_1 dt \quad \text{(III)}$$

Basically, a leading signal is introduced into the control system, the signal being representative of the nearest extrapolated values of the active power flow $\Delta P_1$ max $(\Delta t)+P_2$, which controls the selection of the control law.

The controller for controlling active power flow distribution in power transmission lines realizing the above described method of control comprises in combination: a transducer 1 of actual value of active power flow $P_1$ to be distributed, (FIG. 3), an comparator 2, a setter 3 for presetting the required value of active power flow $P_2$ to be distributed, a logical unit 4 for selecting either a proportional-plus-integral or integral mode of control, a setter 5 for presetting the permissible value of active power flow $P_3$, an integrator 6, an amplifier 7, an adder 8, a control gate 9, a transducer 10 of actual value of active power of the control power station $P_6$ and an adder comparator 11.

An output 12 of the transducer 1 is connected to an input 13 of the comparator 2, while an output 14 of the setter 3 is connected to an input 15 of the comparator 2 and an input 16 of the logical unit 4. An output 17 of the comparator 2 is connected to another input 18 of the logical unit 4, an input 19 of the integrator 6, and an input 20 of the amplifier 7. An output 21 of the setter 5 is connected to an input 22 of the logical unit 4. An output 23 of the logical unit 4 is connected to a control input 24 of the control gate 9. An output 25 of the amplifier 7 is connected to an input 26 of the control gate 9. An output 27 of the integrator 6 and an output 28 of the control gate 9 are connected to inputs 29 and 30 of the adder 8, respectively. An output 31 of the adder comparator 8 is connected to an input 32 of the adder 11, whereas an output 33 of the transducer 10 is connected to an input 35 of the adder comparator 11.

Figure 4:
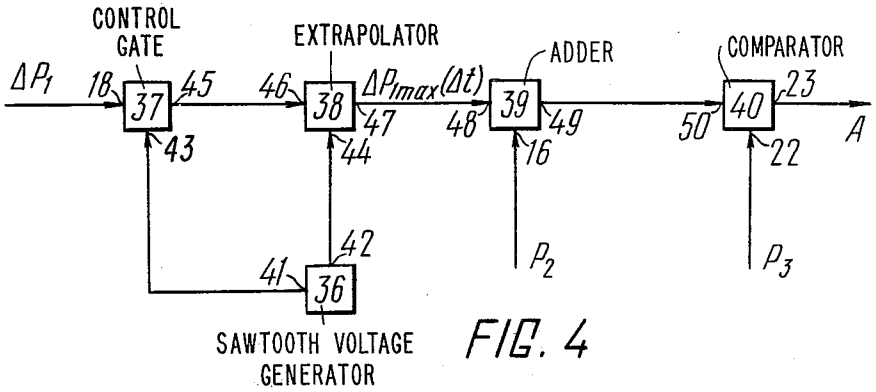
FIG. 4 illustrates a schematic diagram of a logical unit incorporated in the controller for controlling active power flow distribution.

The logical unit 4 which is a component element of the active power flow controller comprises a generator 36 of sawtooth voltage (FIG. 4), a control gate 37, a unit 38 for extrapolating the nearest maximum difference between the actual and preset values of active power flow, an adder 39 and a comparator unit 40.

An output 41 of the generator 36 is connected to a control input 43 of the controlled gate 37, an output 42 of the generator 36 is connected to an input 44 of the extrapolation unit 38. An output 47 of the extrapolation unit 38 is connected to an input 48 of the adder 39, and an output 49 of the adder 39 is connected to an input 50 of the comparator unit 40.

The extrapolation unit 38 is intended for selecting the nearest maximum extrapolated difference between the actual and preset values of the active power flow from a series of extrapolated differences between the actual and preset values of active power flows by the formula (I), the unit being comprised of commonly known elements effecting the operations of multiplication, division, raising to the power, addition, as well as suitably coupled logical elements.

The other assemblies of the controller designated by numerals 1–3, 5–11, 36, 37, 39, 40 are composed of known elements such as resistors, transistors, capacitors, etc., which are components of standard circuits well familar to those skilled in the art.

Figure 3:
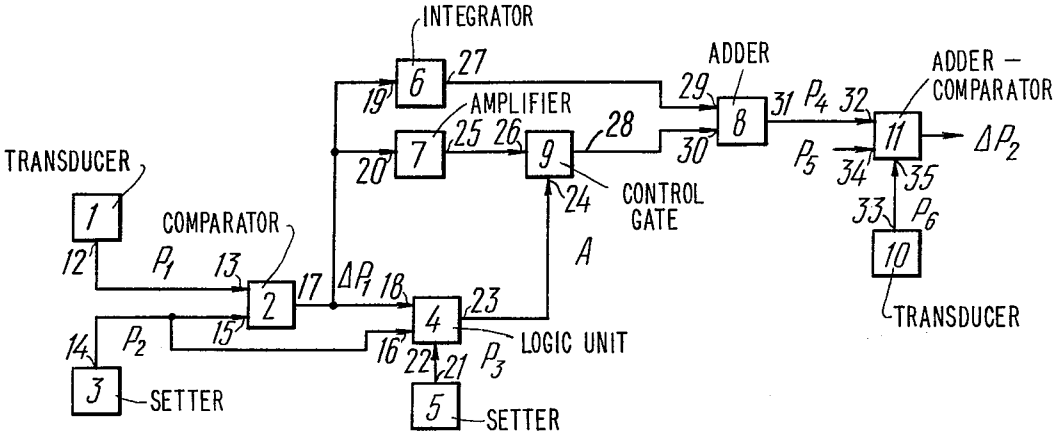
FIG. 3 shows a schematic diagram of a controller according to the invention for controlling the active power flow distribution in a power transmission line.

The active power flow controller for power transmission lines according to the present invention operates as follows:

As is seen from FIG. 3, the actual value of active power flow $P_1$ derived from the output 12 of the transducer 1 is fed to the input 13 of the comparator 2.

The second input 15 of the comparator 2 derives a signal corresponding to the preset value of active power $P_2$ in the power transmission line from the output 14 of the setter 3.

The difference between the actual and preset values of active power flows $\Delta P_1 = P_1 - P_2$, obtained from the output 17 of the comparator 2 is fed to the first input 18 of the logical unit 4 which unit effects control. The second input 16 of the logical unit 4 derives the preset value of the active power flow $P_2$ from the output 14 of the setter 3, whereas the third input 22 thereof derives the permissible value of active power flow $P_3$ from the output 21 of setter 5.

The difference $\Delta P_1$ is also fed from the output 17 of the comparator 2 to the input 19 of the integrator 6 and the input 20 of the amplifier 7. From the integrator 6 the output signal $K_1 \int \Delta P_1 \Delta t$ is applied directly to the adder 8, whereas the output signal $k_2 \Delta P_1$ from the amplifier 7 is applied to the second input 30 of the adder 8 via the controlled gate 9 whose input 26 is connected to the output 25 of the amplifier 7 and the control input 24 is connected to the output 23 of the logical unit 4.

In case $\Delta P_1$ max $(\Delta t) + P_2 > P_3$, an enabling signal A appears at the output of the logical unit 4 to render the controlled gate 9 conducting, which gate thus applying the $k_2 \Delta P_1$ signal from the output 25 of the amplifier 7 to the second input 30 of the adder 8.

In case $\Delta P_1$ max $(\Delta t) + P_2 < P_3$, there is no enabling signal A across the output of the logical unit 4 with the result that the output signal $k_2 \cdot \Delta P_1$ from the amplifier 7 cannot pass to the second input 30 of the adder 8. The control signal $P_4$ from the output 31 of the adder 8 is further applied to the first input 32 of the adder comparator 11 whose second input 34 derives a signal corresponding to the planned or preset power $P_5$ at the control power station, whereas the third input 35 derives a signal representing the actual power of the control power station $p_6$. The difference $\Delta P_2 = P_6 - (P_5 + P_4)$ from the output of the adder-comparator 11 which forms the value of change of active power flows of the power station, is further relayed to the actuating members of the turbines of the control power station.

The logical unit 4 operates as follows. The input 18 of controlled gate 37, which gate is the first input of the logical unit 4, derives the difference between the actual and preset values of the active power flow $\Delta P_1$. The control gate 37 passes the difference $\Delta P_1$ to the input 46 of the extrapolation unit 38 only at the initial stage of extrapolation, with $\Delta t$ being zero. The difference $\Delta P_1$ is converted at a high rate of time in the extrapolation unit 38 into a series of differences $\Delta P_1$ $(\Delta t)$, extrapolated over time intervals $\Delta t$, according to the formula (I). The time interval $\Delta t$ is alternately obtained at a high rate of time from the output 42 of the generator 36. The generator 36 controls the control gate 37 in such a way that the difference $\Delta P_1$ would flow into the input 46 only at the moment $\Delta t = 0$. This is done in order to fix $\Delta P_1$ equal to a constant in the extrapolation unit 38 during the whole computation cycle $\Delta P_1$ $(\Delta t)$ when $\Delta t$ is a variable. From the series of extrapolated differences $\Delta P_1(\Delta t)$ obtained in the extrapolation unit 4, the maximum extrapolated difference $\Delta P_1$ max $(\Delta t)$ is selected. The latter, being derived from the output 47 of the extrapolation unit 38, is applied to the input 48 of the adder 39, whose second input 16 deriving the value $P_2$. The sum $\Delta P_1$ max $(\Delta t) + P_2$ from the output 49 of the adder 39 is applied to the input 50 of the comparator unit 40, whose second input 22 derives the value $P_3$.

If $\Delta P_1$ max $(\Delta t) + P_2 > P_3$, the output 23 of the comparator unit 40 applies an enabling signal A across the control input 24 of the control gate 9. However, if $\Delta P_1$ max $(\Delta t) + P_2 < P_3$, there will be no enabling signal A across the output 23 of the comparator unit 40.

The method for controlling the active power flow distribution has been tested in practice in a 330 kV power transmission line operating to couple two parallel power distribution systems. The test results displayed sufficient accuracy of extrapolating the difference between the actual and preset values of active power flows within a time interval of up to 5 minutes, and the overall usefulness of the controller as a whole.

What is claimed is:

1. A method for controlling the active power flow distribution in a power transmission line comprising the steps of:

a. presetting the value of active power flow in a power transmission line intended to be maintained in the process of controlling;

b. measuring the actual value of the active power flow in said power transmission line;

c. comparing said actual and preset values of active power flows in said power transmission line and deriving the difference therebetween;

d. converting the difference between said actual and preset values of active power flows in said power transmission line into the nearest maximum extrapolated difference between the preset and actual values of active power flow;

e. adding to obtain the sum of the nearest maximum extrapolated difference between the actual and preset values of active power flow thus obtained and the preset value of active power flow;

f. setting the permissible value of active power flow in said power transmission line to ensure stable operation of the power distribution system;

g. comparing said sum of comprised of the nearest maximum extrapolated difference between the actual and preset values of active power flow and the preset value of active power flow to said permissible value of active power flow in said power transmission line;

h. carrying out a proportional-plus-integral control of active power flow if said sum of the nearest maximum extrapolated difference between the actual and preset active power flow and the preset value of active power flow is greater than said permissible value of active power flow in said power transmission line, or alternately effecting an integral control of the active power flow if said sum of the nearest maximum extrapolated difference between, the actual and preset values of the active power flow and the preset value of actual power flow is smaller than said permissible value of active power flow in the said power transmission line.

2. A method for controlling the active power flow distribution in a power transmission line as claimed in claim 1, wherein the nearest maximum extrapolated difference between the actual and preset values of active power flow is selected from a series of extrapolated differences between the actual and preset values of active power flow, respectively determined for different time intervals relative to the moment of time the actual value of active power flow is measured by the formula:

$$\Delta P_1(\Delta t) = \frac{\alpha e^{-\beta \Delta t} - \beta e^{-\alpha \Delta t}}{\alpha - \beta} \Delta P_1 + \frac{e^{-\beta \Delta t} - e^{-\alpha \Delta t}}{\alpha - \beta} \cdot \frac{d\Delta P_1}{dt} \quad (I),$$

wherein $\Delta P_1$ is the difference between the actual and preset values of active power flow in the power transmission line at the moment of time the actual value relative to which the time intervals are counted off is measured;

$\Delta P_1$ $(\Delta t)$ is the difference between the actual and preset values of active power flow;

$\alpha$ and $\beta$ are coefficients characterizing the probable character of active power flow fluctuations in the power transmission line.

3. A controller for controlling the active power flow distribution in a power transmission line comprising in combination:

a. an active power flow transducer;

b. a first setter for setting the value of active power flow to be distributed and maintained in the process of controlling;

c. a first comparator having two inputs, one input thereof being connected to the output of said transducer for active power flow, the second input thereof being connected to the output of said first setter for active power flow;

d. converter means connected to the output of said first comparator, for converting the difference between said actual and preset values of active power flow in the transmission line into nearest maximum extrapolated difference between the preset and actual values of active power flow;

e. an adder connected to said first setter and to said convertor to obtain the sum of the nearest maximum extrapolated difference between the actual and preset values of active power flow thus obtained and the preset value of active power flow;

f. a second setter for setting the permissible value of active power flow in the power transmission line to ensure stable operation of the power distribution system;

g. a second comparator connected to said adder and said second setter for comparing the sum of the nearest maximum extrapolated difference between the actual and preset values of active power flow and the preset value of active power flow to said permissible value of active power flow in the power transmission line; and h. means connected to said second comparator for carrying out a proportional-plus-integral control of active power flow if said sum of the nearest maximum extrapolated difference between the actual and preset active power flow and the preset value of active power flow is greater than said permissible value of active power flow in said power transmission line, or alternately effecting an integral control of the active power flow if said sum of the nearest maximum extrapolated difference between, the actual and preset values of the active power flow and the preset value of actual power flow is smaller than said permissible value of active power flow in the said power transmission line.

4. A controller for controlling the active power flow distribution in a power transmission line comprising in combination:

a. an active power flow transducer;

b. a first setter for setting the value of active power flow to be distributed and maintained in the process of controlling;

c. a comparator having two inputs, one input being connected to the output of said transducer for active power flow, the second input thereof being connected to the output of said first setter for active power flow;

d. a second setter for setting the permissible value of active power flow in the power transmission line to ensure stable operation of the power distribution system;

e. a logical unit having three inputs respectively connected to said comparator, said first setter and said second setter, said logical unit including extrapolation means for extrapolating the maximum difference between the actual and preset values of active power flow and including an adder for adding said extrapolated maximum difference to the output of said first setter;

f. an integrator having an input connected to the output of said comparator;

g. an amplifier having an input connected to the output of said comparator;

h. a controlled gate having an input connected to the output of said amplifier and having a control input connected to the output of said logical unit; and i. an output adder having two inputs and an output, one input thereof being connected to the output of said integrator, the second input being connected to the output of said amplifier by way of said controlled gate, a control signal being formed at the output of said output adder which controls the distribution of active power flow in the power transmission line, said control signal effecting proportional-plus-integral control when the output of said adder of said logical unit exceeds said permissible value and effecting integral control when the output of said adder of said logical unit is less than said permissible value.

5. A controller as defined in claim 4, wherein said logical unit further comprises a comparator having two inputs and an output, the first input thereof being connected to the output of said adder of said logical unit, the second input thereof being connected to said second setter, and the output thereof being connected to said controlled gate, whereby said logical unit determines the mode of control between proportional-plus-integral or integral based on the actual, preset, permissible and extrapolated probable values of the transmission line power flow distributions.

6. A controller as defined in claim 4, wherein said extrapolation means comprising a sawtooth voltage generator; an extrapolator having two inputs, one of which is connected to the output of said sawtooth generator, and an output connected to one input of said adder of said logical unit; and a controlled gate having the input thereof connected to said comparator, having the control input thereof connected to said sawtooth voltage generator, and having the output thereof connected to the other input of said extrapolator.

* * * * *